US006379173B1

(12) United States Patent
Fonteneau et al.

(10) Patent No.: US 6,379,173 B1
(45) Date of Patent: Apr. 30, 2002

(54) DETACHABLE CONNECTOR

(75) Inventors: Michel Fonteneau, Le Mans; Michel Pesson, Sille le Philippe, both of (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/686,159

(22) Filed: Oct. 11, 2000

(30) Foreign Application Priority Data

Oct. 14, 1999 (FR) ..... 99 12840

(51) Int. Cl.[7] ..... H01R 13/627
(52) U.S. Cl. ..... 439/352
(58) Field of Search ..... 439/352, 357, 439/358

(56) References Cited

U.S. PATENT DOCUMENTS 5,244,415 A 9/1993 Marsilio et al. ..... 439/610
5,330,366 A 7/1994 Tsuji et al. ..... 439/352
5,332,330 A * 7/1994 Kaneko ..... 403/321
5,342,215 A 8/1994 Silbernagel et al. ..... 439/357
5,613,870 A * 3/1997 Traver, Jr. ..... 439/352
5,910,027 A * 6/1999 Wayt et al. ..... 439/489
6,045,388 A * 4/2000 Higgins et al. ..... 439/352
6,179,642 B1 * 1/2001 Hwang ..... 439/358

FOREIGN PATENT DOCUMENTS

FR 2656165 A1 6/1991

* cited by examiner

*Primary Examiner*—Neil Abrams
*Assistant Examiner*—Thanh-Tam Le
(74) *Attorney, Agent, or Firm*—Perman & Green, LLP

(57) ABSTRACT

A connector (1) which has a release (28) for releasing an elastic hooked tab (11) which allows to keep a complementary connector (23) connected with said connector. The release of said connector particularly includes a lateral blade (30) disposed in a slit (14) extending between the main body (6, 7, 9) of the connector and the hooked tab of said connector, in such a manner that it can selectively draw or not the hooked tab away from the connector thereby releasing or not the elastic lock of the connector.

7 Claims, 1 Drawing Sheet

DETACHABLE CONNECTOR

BACKGROUND OF THE INVENTION

The present invention relates to a detachable connector. More particularly, it finds use in the field of miniature connectors to be connected, for instance, to a printed board, in an environment which provides very little clearance, particularly in an environment cluttered with wires and cables, e.g behind a car dashboard. In fact, behind a car dashboard, particularly in a car having a system for managing monitoring and/or controlling functions of the vehicle, clutter is at its maximum. The interest of the invention consists in that it provides a connector mounted by means of an elastic lock onto a complementary connector, and such that the connector of the invention provides easy release of the hooked tab.

DESCRIPTION OF THE PRIOR ART

In prior art, a connector is known which comprises a cover and contacts, such as, for instance, the one described in patent U.S. Pat. No. 5,244,415, the cover having wires at a first end thereof, so that the contacts provided at a second front end of the cover are connected to said wires. The conductors of these wires are then joined to the contacts inside the cover. The cover preferably has a large flat surface and is thin. The contacts are provided on a surface of the cover which connects together two parallel large flat surfaces of the cover. This connector generally has a trapezoidal shape. It is known as a SUB D-type connector. As contacts, a SUB D connector has male pins or female sockets, over a trapezoidal surface. Typically, this trapezoidal surface is encircled by an equally trapezoidal peripheral metal frame. Said peripheral metal frame is higher than the pins or sockets of the contact, so that it can protect them. This connector is designed to be connected to a complementary connector. The complementary connector may be, for instance, separate, or located on a printed board. In order to keep the connector connected with the complementary connector, a connector may be used whose cover is such that it includes a main body and one or more hooked tabs. The hooked tab is flexibly fitted on the cover body. Also, the hooked tab has a hook. Therefore, the hooked tab is allowed little movement to displace the hook so that, in a first position, the hook is drawn apart, thereby allowing an unrestrained connection of the connector with its complementary connector, and in a second rest position, the hook is engaged on a projection of the complementary connector.

In prior art, such connector is connected on a complementary connector by typically forcing a projection of the complementary connector against the hook of the hooked tab. In fact, the hook is chamfered to allow the elastic hooked tab to be drawn apart under the stress of the projection of the complementary connector, upon connection thereof. In prior art, such connector is disconnected, i.e. the elastic lock is disengaged from the hooked tab, secured on a second projection of the complementary connector, by drawing the hooked tab away from the cover. In order to draw said elastic hooked tab apart, a thin and elongated object is used, such as a screwdriver or a blade, which is slipped into the slit between the hooked tab and the cover body to draw the hooked tab away from the body. Once the hooked tab has been drawn apart, the connector is pulled out to disengage the contacts, thereby disconnecting the two connectors.

Prior art connectors involve a problem. While they can be easily connected onto a complementary connector, they are not so easily disconnected from said complementary connector, when the connection takes place in a cluttered environment. A long object, such as a screwdriver or a blade is difficult to handle in such an environment cluttered with wires and cables. Handling such an element might as well be dangerous, involving the risk of unintentionally cutting, displacing or disconnecting any of these cables and wires. A safe disconnection of two connectors in such an environment requires delicate, long and difficult operations.

SUMMARY OF THE INVENTION

The invention has the object to obviate the above problems by providing a connector with a detachment system: a release. Thus, a connector according to the invention includes a release which may be moved in a slit formed between a hooked tab and a main body of a connector cover. The release particularly includes a transverse blade disposed across the slit. The release is movable, hence the transverse blade is movable within the slit. Depending on the position of the blade inside the slit, the blade gets more or less in contact with the hooked tab and with the cover body. This release is mounted before connecting the connector to a complementary connector. Furthermore, the release may be placed in a backward position so that it cannot interfere with the connection of a complementary connector on this connector.

In the backward position, the transverse blade of the release exerts no constraint on the hooked tab. Conversely, when the release is moved to a forward position, it exerts a force on said hooked tab to drive it apart thereby disengaging the elastic lock. Therefore, no tool is required to drive the hooked tab apart what is only needed is to displace the release so that the transverse blade of the release draws the hooked tab apart. The release has a plate which can slide along a flat surface of the cover. The plate is also very thin and does not appreciably increase the comprehensive thickness of the cover. A movement exerted on this plate allows to displace the transverse blade inside the slit.

Thus, the invention relates to a connector comprising a cover and at least one contact fitted therein, the cover having a body and at least one hooked tab, a slit being formed between the hooked tab and the body and the hooked tab having a hook for engagement in a complementary connector, characterized in that it includes a release, movable within the slit, the release having at least one lateral transverse blade in the slit, to draw the hooked tab away from the body.

DESCRIPTION OF THE DRAWINGS

The invention will be understood more clearly by reading the following description and by analyzing the accompanying figures. The latter are only shown by way of example and do not intend to limit the invention in any manner. The figures show.

DESCRIPTION OF THE PREFERRED EMBODIMENTS

Figure 1:
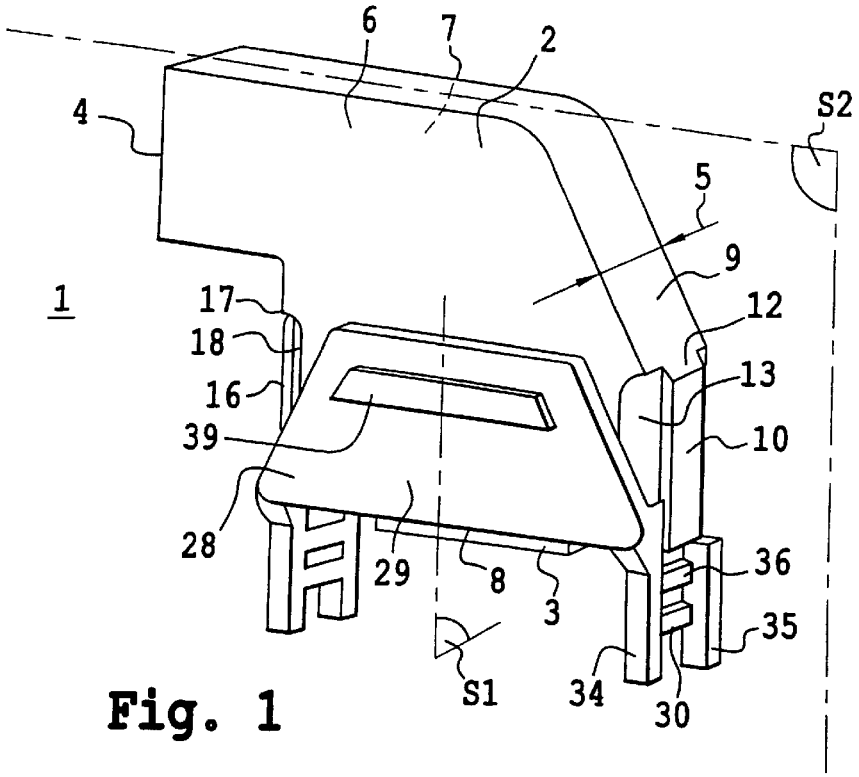
FIG. 1: a perspective view of a connector according to the invention.

FIG. 1 shows a connector 1 according to the invention. The connector 1 comprises a cover 2 and at least one contact 3. The cover 2 preferably has insulating properties. At a first end 4, it can receive wires (not shown) to be connected, inside the cover 2, to contacts such as the contact 3. The cover 2 has a small thickness 5. The cover 2 particularly has a front surface 6, relative to a rear surface 7, which is opposite and parallel to said front surface 6. The thickness 5 is defined by the distance between the surfaces 6 and 7. The contact 3 is provided at a second end 8 of the cover 2, so that the cover 2 has an edge 9 connecting together the front surface 6 and the rear surface 7, except at the first opening 4 and at said second opening 8. The edge 9 defines nearly all the periphery of the surfaces 6 and 7.

The edge 9 includes an elastic tongue 10, so that this elastic tongue 10 forms a hooked tab 11 at the second opening 8 of the cover 2. In fact, the elastic tongue 10 protrudes out of the edge 9 at an undercut 12 of said edge 9. When no constraint is exerted, the elastic tongue 10 is not parallel to a portion 13 of the edge 9. At its free end, the elastic tongue 10 is closer to the portion 13 to allow exertion of constraint after connection, to ensure proper mechanical resistance when the connector is joined to a complementary connector. This portion 13 being situated between the undercut 12 and the opening 8. A slit 14 is then defined between the portion 13 and an inner face 15 of the elastic tongue 10, as shown in FIG. 2.

Figure 2:
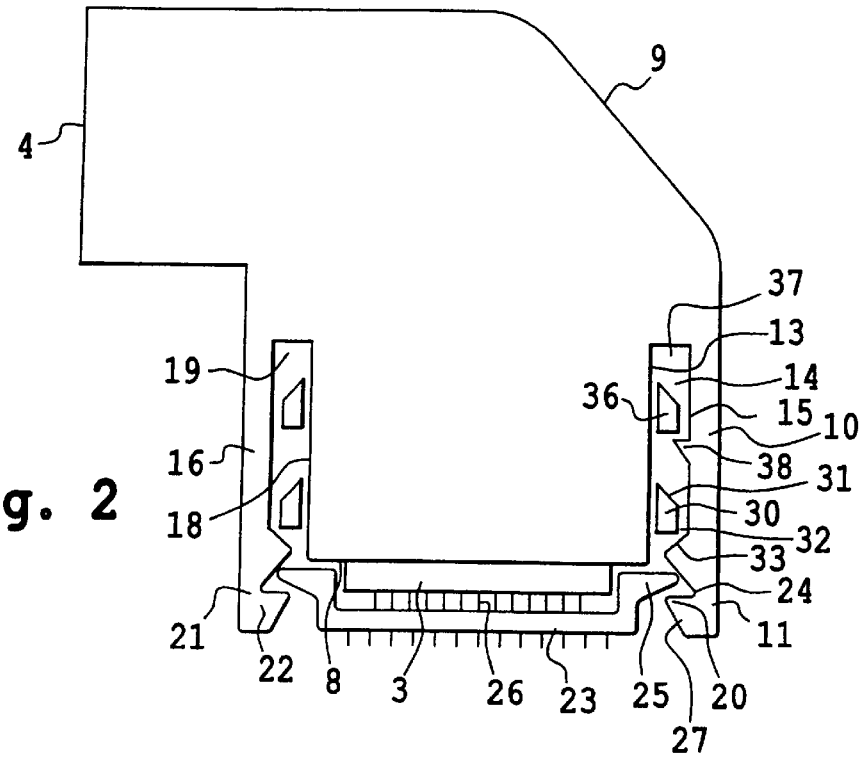
FIG. 2: a sectional view of a connector according to the invention with respect to a cutting plane as shown in FIG. 1.

In a preferred embodiment of the invention, the connector 1 is such that the cover 2 has a plane of symmetry S1, as shown in FIG. 1, at the front part of the cover 2 towards the second opening 8. in the example as shown in FIG. 2, the cover 2 has a second elastic tongue 16 like the tongue 10, a second undercut 17, like the undercut 12, of the edge 9, a second portion 18 like the portion 13 on said edge 9, the second portion 18 extending between the second undercut 17 and the second opening 8. Hence, in this example, a second slit 19 is defined between the second elastic tongue 10 and the portion 18.

The hooked tab 11 has a hook 20. Similarly, in a preferred example, the second elastic tongue 16 also defines a hooked tab 21, said hooked tab 21 also having a hook 22, like the hook 20. The hook 20 faces the hook 22. These hooks 20 and 22 can lock a complementary connector 23, engaging in an outer surface of said complementary connector 23. The hooks 20 and 22 have projections, so that these projections can be locked in the complementary projections of the complementary connector 23. In one embodiment, the hook 20 has, for instance, a recess 24 wherein a protuberance 25 of the complementary connector 23 is locked.

The complementary connector 23 has at least one contact 26, complementary to the contact 3. The contact 3 is typically a male pin or a female contact disposed in a trapezoidal perimeter. In fact, the pins are encircled by a metal trapezoidal shield, known as SUB D. Complementary contacts 26 provided by the complementary connector 23 are then disposed in front of the pins 3. The connector 23 may be, for instance, a connector fitted on a cable, or a connector secured on a printed board.

In order that a complementary connector like the connector 23 may be connected on the contact 3, the elastic tongue 10 must be spaced apart from the portion 13. In fact, by drawing the elastic tongue 10 apart, the hook 20 is drawn away from the contact 3. Hence, the complementary connector 23 may be connected with no interference by the protuberance 25. In a first illustrated case, the hook 20 may be drawn apart by hand to allow such connection. In a second case, the hook 20 has a chamfer 27 so that, when the projection 25 rests against the hook 20, the projection 25 slides along the chamfer 27 to draw temporarily the hook 20 apart.

Once the hooked tab 11 has been drawn apart, and the complementary connector 23 has been connected, the hooked tab 11 snaps elastically, and the recess 24 of the hook 20 locks the protuberance 25. Conversely, in order to disconnect the complementary connector 23, the complementary connector 23 cannot be simply pulled out to disengage the protuberance 25 from the recess 24 In fact, the recess 24 is not chamfered, in which case it would not have its locking function. The recess 24 allows to hold firmly the complementary protuberance 25 in one variant, the elastic lock of the cover on the complementary connector may consist in the engagement of a protuberance of the hooked tab in a recess of the body of the complementary connector.

Drawing the hooked tab 11 apart is necessary to unlock the mutually engaged projections 24 and 25. In order to do this, the connector 1 has a release 28. The release 28 particularly includes a plate 29, as shown in FIG. 1, sliding along the front surface 6 and a lateral blade 30. The lateral blade 30 is preferably orthogonal to the plane formed by the plate 29. As a result, it is also orthogonal to the plane formed by the surfaces 6 and 7.

The release 28 is conceived in such a manner that the lateral blade 30 may slide in the slit 14. Moreover, the size of said lateral blade 30 is such that the release 28 is movable and may be displaced in the slit 14 between a forward position and a backward position. The forward and backward positions correspond to the widest displacement of the lateral blade 30 within the slit 14. The lateral blade 30 has a chamfer 31, so that said chamfer 31 interacts with the chamfer 27 of the hook 20 when the release 28 is fitted on the cover 2. Also, the lateral blade 30 has a free edge 32 such that the free edge 32 may rest against a undercut 33 provided on the inner surface 16 of the hooked tab 11. When the release 28 is displaced towards the forward position (towards the surface 7), the transverse blade 30 is displaced inside the slit 14, whereby the portion 31 is constrained against a second undercut 38. This movement allows to draw the hooked tab 11 apart. Thereby the protuberance 25, locked in the complementary recess 24 may be unlocked. Hence, detachment of the connector 1 from said complementary connector 23 may be obtained.

In one embodiment shown in FIG. 1, the release has two rails 34 and 35 on both sides of the transverse blade 30. The rail 34 is, for instance, integral with the pad 29. The rails 34 and 35 are conceived in such a manner that they can slide on both sides of the elastic tongue 10. In one embodiment, the rail 34 slides along the side of the front surface 6 and the rail 35 slides along the side of the rear surface 7. These two rails 34 and 35 allow to screen the slit 14. Therefore, no surrounding wire or cable can jam in the slit 14, nor interfere with the mechanisms for locking the connector 1 onto a complementary connector.

In one variant, the release 28 has two lateral blades like the blades 30. So, as shown in FIG. 1 the release 28 has a second lateral blade 36. said second lateral blade 36 is fitted in a bottom 37 of the slit 14. The second lateral blade 36 may be used, for instance, to hold the release 28 on the cover 2. Regardless of the movement exerted on the release 28, the latter is held on the cover 2 thanks to said second lateral blade 36. For instance, the second lateral blade 36 may be arranged to abut against the second undercut 38 provided on the inner surface 15 of the elastic tongue 10. In this case, the second lateral blade 36 has chamfer to interact with a chamfer of said second undercut 38, when the release 28 is fitted on the cover 2. Hence, the release 28 is prevented from coming out of its housing. The release 28 remains integral with the cover 2. Hence, it is almost made of one piece with the cover 2.

For easier maintenance and handling of the release 28, the release 28 has a gripping area 39 on the plate 29. This gripping area 39 allows to keep a finger thereon for better displacement of the release 28 parallel to the front surface 6. This gripping area 39 may also have two cavities (material removal) for an even easier grip.

In one embodiment of the invention, the cover 2 has a second plane of symmetry 52 orthogonal to the plane of symmetry S1. Further, the release 28 may be slipped both parallel to the front surface 6 and parallel to the back surface 7. Provided that the elastic tongue 10 is disposed exactly at the middle of the edge 9. In one variant, a release 28 may be also provided, which has a second plate (not shown), like the plate 29, so that the cover 2 has a means for releasing the elastic tongues on both sides of the surfaces 6 and 7 of the cover 2. Depending on the clutter in the space wherein the connector is mounted, the hooked tabs may be released on one side or on the other of the connector 1.

The release may also have an end-of-stroke area wherein it remains locked in position. This variant allows to separate the opening effort from the connector detachment effort, thereby providing a higher operating convenience.

What is claimed is:

1. A connector comprising a cover and at least one contact fitted therein, the cover having a body and at lest one hooked tab, a slit being formed between the hooked tab and the body and the hooked tab having a hook for engagement in a complementary connector, wherein the connector includes a release, movable within the slit, the release having at least one lateral transverse blade in the slit, to draw the hooked tab away from the body, the release having a plane of symmetry and being removable.

2. A connector as claimed in claim 1, wherein said release is movable between a backward position, wherein a projection of said hook is locked in a complementary projection of said complementary connector, and a forward position, wherein a lateral blade rests against an undercut of said hooked tab to draw the hook projection away from said complementary projection.

3. A connector as claimed in claim 1, wherein said release has a plate attached to a transverse blade to slide along said cover.

4. A connector as claimed in claim 1, wherein said release has two rails sliding on both sides of said hooked tab, whereby said transverse blade is fitted between said two rails across said slit.

5. A connector as claimed in claim 1, wherein said connector includes a second hook which is symmetrical to said hook of said hooked tab.

6. A connector as claimed in claim 1, wherein said release has two lateral transverse blades in said slit.

7. A connector as claimed in claim 1, wherein said cover is of the sub D type.

* * * * *